US006705533B2

(12) United States Patent
Casey et al.

(10) Patent No.: US 6,705,533 B2
(45) Date of Patent: Mar. 16, 2004

(54) DIGITAL MODULATION FOR A GAS-FIRED HEATER

(75) Inventors: Steven Casey, Arlington, MA (US); John Bowman, Lancaster, MA (US)

(73) Assignee: Gas Research Institute, Des Plaines, IL (US)

( * ) Notice: Subject to any disclaimer, the term of this patent is extended or adjusted under 35 U.S.C. 154(b) by 284 days.

(21) Appl. No.: 09/839,595

(22) Filed: Apr. 20, 2001

(65) Prior Publication Data

US 2002/0155404 A1 Oct. 24, 2002

(51) Int. Cl.[7] ..... G05D 23/00; G05B 11/18
(52) U.S. Cl. ..... 236/1 E; 236/78 D; 318/596
(58) Field of Search ..... 236/1 E, 1 EB, 236/78 D, 10; 318/596

(56) References Cited

U.S. PATENT DOCUMENTS

| | | | | |
|---|---|---|---|---|
| 3,308,869 A | | 3/1967 | Livingston | |
| 3,419,775 A | * | 12/1968 | Kardos | 318/596 X |
| 3,797,988 A | | 3/1974 | Davidson | 431/12 |
| 4,252,300 A | | 2/1981 | Herder | 431/48 X |
| 4,257,318 A | * | 3/1981 | Johannsen | 236/78 D X |
| 4,431,131 A | | 2/1984 | McInnes | 236/11 |
| 4,443,157 A | * | 4/1984 | Yoshii | 236/78 D X |
| 4,476,850 A | | 10/1984 | Pickering | 126/112 |
| 4,614,491 A | | 9/1986 | Welden | 431/60 |
| 4,874,311 A | | 10/1989 | Gitman | 432/13 |
| 4,887,958 A | | 12/1989 | Hagar | 431/12 |
| 5,295,820 A | | 3/1994 | Bilcik et al. | 431/280 |
| 5,470,018 A | | 11/1995 | Smith | 236/15 A |
| 5,513,979 A | | 5/1996 | Pallek et al. | 431/90 |
| 5,549,469 A | | 8/1996 | Wild et al. | 431/75 |
| 5,660,542 A | | 8/1997 | Rinker et al. | 432/19 |
| 5,749,718 A | | 5/1998 | Berlincourt | 431/60 |
| 5,813,320 A | | 9/1998 | Frasnetti et al. | 236/20 A |
| 5,931,652 A | | 8/1999 | Epworth | 431/3 |
| 5,934,431 A | | 8/1999 | Bladow | 192/85 R |
| 5,961,317 A | | 10/1999 | Fauci | 431/174 |

OTHER PUBLICATIONS

Co–pending patent application Ser. No. #09/839,597.

* cited by examiner

*Primary Examiner*—William Wayner
(74) *Attorney, Agent, or Firm*—Mark E. Fejer

(57) ABSTRACT

A method is disclosed for operating a gas-fired heater to maintain temperature within a zone. The gas-fired heater is modulated between a higher firing rate and a lower firing rate within a pseudo steady-state mode until a current firing rate exceeds a predetermined maximum time period $t_{trans}$. The gas-fired heater is then modulated between an updated higher firing rate and an updated lower firing rate within a transient mode until an updated current firing rate exceeds a predetermined maximum time period $t_{diag}$. Finally, the higher firing rate and the lower firing rate are redefined in a diagnostic mode until the gas-fired heater returns to the pseudo steady-state mode.

13 Claims, 10 Drawing Sheets

NOTE: ASSUMED LOAD IS 65%.

NOTE: ASSUMED LOAD IS 65%.

NOTE: ASSUMED LOAD IS 65%.

DIGITAL MODULATION FOR A GAS-FIRED HEATER

BACKGROUND OF THE INVENTION

1. Field of the Invention

This invention relates to heat modulation of a gas-fired heater, particularly a heater suitable for installation outdoors. This invention relates to digital heat modulation to incrementally modulate a heat input to a gas-fired heater by independently controlling and operating at least one solenoid valve to activate or deactivate a corresponding burner, such as an in-shot burner. The digital heat modulation method and apparatus of this invention can be easily adapted to receive one or more input data signals from a conventional single-stage or two-stage thermostat, so that a control algorithm of a modulator can provide an output signal to digitally control heat modulation.

2. Description of Related Art

Conventional outdoor or rooftop heating units are sized to a building heating design load. According to heating, ventilation and air-conditioning (HVAC) design practice, a heating unit preferably has a maximum capacity greater than the building heating design load. Generally, a rooftop heating unit is oversized 1.2 times to 1.7 times the building heating design load. An oversized heating unit responds quickly to a thermostat set point from a much lower set point condition, such as those associated with operation during evenings, weekends, and other unoccupied times.

A building heating design load includes an amount of heat needed to warm outside air that is mixed with return air, to ventilate the building. Increasing requirements and expectations for indoor air quality may require an HVAC system to introduce more outside air to a building. The amount of outside air introduced to a rooftop heating unit can range from about 20% to about 35% of the total air flow through the rooftop heating unit.

Many conventional rooftop heating units have a constant volume operation for controlling air flow to satisfy indoor air quality requirements. In a constant volume operation, a supply blower runs continuously in an on mode, regardless of whether the rooftop heating unit burners are firing.

As a result of the percentage of outside air introduced into the rooftop heating unit and constant volume operation, vent outlet air temperatures may drop quickly during off-cycle periods and may discomfort many occupants. To prevent these temperature fluctuations that may discomfort occupants, the heat input of conventional rooftop heating units is modulated.

In many conventional rooftop heating units, the heat input is adjusted by modulating a main gas valve. Thus, all burners of the rooftop heating unit are modulated simultaneously. This modulation approach limits turndown to about 3:1. With a turndown of about 3:1, excess combustion air is significantly increased and thus decreases the rooftop heating unit efficiency. To achieve a turndown of about 3:1 and to maintain efficiency these approaches require a multi-speed inducer fan to control excess combustion air. Further, if excess combustion air is controlled to maintain a constant air-to-fuel ratio, as the rooftop heating unit is turned down, the combustion products may condense in the heat exchanger or may condense in unintended portions of the heat exchanger. To avoid this condensation of combustion products and the subsequent corrosion damage to the heat exchanger requires a multi-speed indoor air blower to control condensation.

To provide some degree of heat modulation many conventional rooftop units use a two-stage main gas valve and are controlled by either a single-stage or two-stage thermostat. Conventional rooftop units equipped with a two-stage main gas valve can operate the burners at a full firing rate, at approximately 70% of the full firing rate and in an off condition, to maintain set points and to provide more continuous heat input to the rooftop heating unit while satisfying thermostat set points.

However, recognizing that for most operating hours of a unit the building load is less than 50% of the full firing rate, a rooftop heating unit with a two-stage main gas valve, which can only reduce the unit firing rate to about 70% of the full firing rate, will often provide heat input well above the heat load requirement. Therefore, to meet the heating load requirements, a rooftop heating unit will cycle between the on mode and the off mode, with the off-cycle periods increasing as the heating load decreases. As a result, many conventional rooftop heating units with a two-stage main gas valve do not improve the comfort level of the air circulated through the conditioned space of the building.

There is an apparent need for an outdoor or rooftop heating unit that reduces fluctuations in the supply air temperature to improve the comfort level of the air circulated through the conditioned building space.

It is also apparent that there is a need for a heat modulation method that incrementally modulates the heat input to a gas-fired heater for better control of the supply air temperature.

SUMMARY OF THE INVENTION

It is an object of this invention to provide a gas-fired heater having a heat modulation device that independently controls the activation of in-shot burners to modulate a heat input to a gas-fired heater over a wide range of overall firing rates.

It is another object of this invention to provide a heat modulation device that incrementally modulates a heat input to a gas-fired heater by independently operating solenoid valves to activate and deactivate corresponding in-shot burners.

It is another object of this invention to provide a heat modulation device that controls the activation or deactivation of a plurality of in-shot burners based only on feedback from a single-stage thermostat.

It is another object of this invention to provide a heat modulation device that manages the feedback from a single-stage thermostat, the initiation of the electronic ignition system of a gas-fired heater, the activation or deactivation of the main gas or combination gas valve of a gas-fired heater, and the activation or deactivation of independently operating solenoid valves.

It is another object of this invention to independently and/or sequentially control activation of a plurality of in-shot burners and to control a firing rate of at least one in-shot burner.

It is yet another object of this invention to control the amount of excess air in the gas-fired heater with a multi-speed inducer fan or with another flow restriction device.

The above and other objects of this invention are accomplished with a gas-fired heater, for example an outdoor or rooftop heater, having a plurality of burners, for example in-shot burners, each corresponding to a discrete section of a heat exchanger. The burners can have either approximately equal firing rates or different firing rates. In one embodiment of this invention, at least one burner has a variable firing rate.

Each burner is in fluidic communication with a fuel supply which furnishes a fuel to each burner. Within the burner the fuel is mixed with some portion of the air needed for complete combustion. Flames issue from the burners, mix with at least the remaining portion of air needed for complete combustion, and enter into the heat exchanger sections releasing heat and combustion products into the heat exchanger sections.

An induced draft fan, activated by a modulation controller, is preferably mounted to communicate with the combustion heat exchanger. The induced draft fan draws the combustion products through the heat exchanger and discharges the combustion products to the atmosphere.

A pressure switch mounted upstream of an induced draft fan or a centrifugal switch attached to the induced draft fan is responsive to a pressure or a rotational speed, respectively, within a range of normal operation. A pressure or rotational speed within a range of normal operation causes a pressure switch or centrifugal switch to electrically energize an electronic ignition system.

Once energized, an electronic ignition system electrically communicates with an ignition source or sources near one or more of the burners or near a pilot burner, the main gas valve or combination gas valve including a pilot valve section and a flame sensing device. An electronic ignition system safely and reliably lights the burners and any pilot burner.

The gas-fired heater has a supply blower which draws air from both the conditioned space of the building and the outside air. The blower moves the air over the heat exchanger. The heat exchanger transfers heat by convection and/or conduction to the air. The heated air is forced through a conduit, a duct system for example, and circulated throughout the conditioned space of a building.

At least one valve, such as a solenoid valve is positioned with respect to a corresponding burner. Each valve is independently controlled and/or moved between an open position and a closed position, to control fuel flow from the fuel supply to the corresponding burner.

A modulator electrically communicates with each valve and emits a signal that is used to control movement, if any, of each valve, such as between an open position and a closed position. The modulator of this invention incrementally modulates the heat input rate to the gas-fired heater by independently moving at least one valve to the open position or the closed position.

A single-stage or two-stage thermostat, preferably a single-stage thermostat, electrically communicates with the modulator to provide feedback on the heat input rate by closing the thermostat circuit to signal that the heating load is not met or by opening the thermostat circuit to signal that the heating load is met.

In a method for modulating the heat input to the gas-fired heater, the modulator emits a control signal, preferably but not necessarily a dedicated signal, to each solenoid valve to independently operate or control each solenoid valve, such as between the open position and the closed position. With the solenoid valve in the open position, the fuel flows from the fuel supply to the corresponding burner. The modulator can also activate any burner by emitting a control signal to ignite and combust or burn the fuel. Additional solenoid valves can be independently or collectively operated or controlled to move from the closed position, which prevents or restricts fluidic communication between the fuel supply and the corresponding burner, to an open position allowing fluidic communication between the fuel supply and the corresponding burner. The dedicated signal selectively activates the corresponding burner. Thus, the heat input to the gas-fired heater can be incrementally modulated.

The modulator of this invention uses a control algorithm that can receive a signal emitted from a conventional single-stage or two-stage thermostat and in response emit one or more control signals to one or more of the burners and to an electronic ignition system, to digitally control modulation.

BRIEF DESCRIPTION OF THE DRAWINGS

The drawings show different features of a gas-fired heater having a modulation device for controlling a heat input to the gas-fired heater, according to different embodiments of this invention, wherein.

DETAILED DESCRIPTION OF PREFERRED EMBODIMENTS

Figure 1:
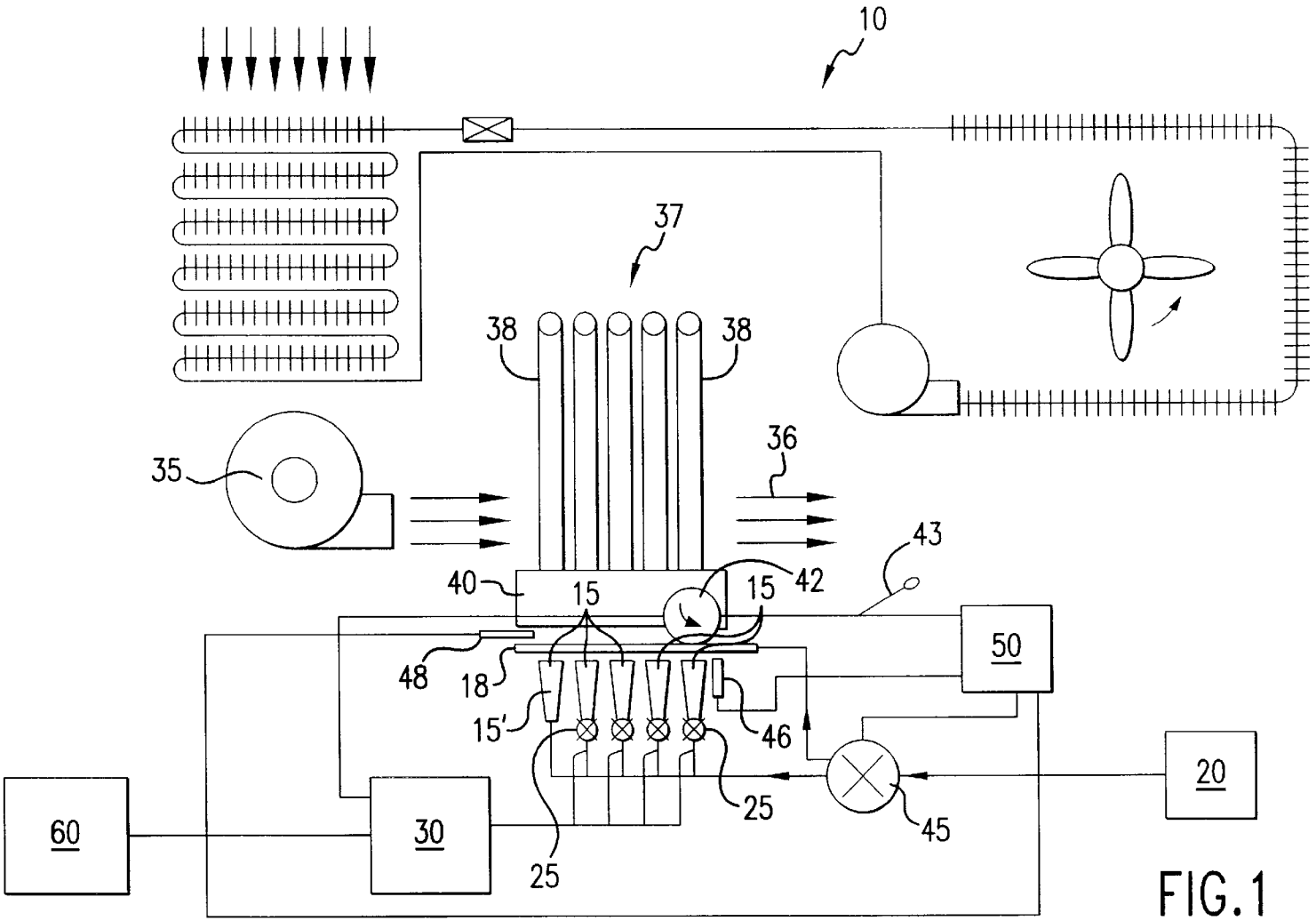
FIG. 1 is a schematic view of a gas-fired heater, according to one preferred embodiment of this invention.

A gas-fired heater 10, for example an outdoor or rooftop heater as shown in FIG. 1, comprises a plurality of burners 15, such as in-shot burners. As used throughout this specification and in the claims, the term burner is intended to relate to an in-shot burner and/or any other suitable burner for a gas-heater, as known to those skilled in the art of furnace design. In one preferred embodiment of this invention, burners 15 have approximately equal firing rates. For example, gas-fired heater 10 may have an overall or total firing rate of about 100,000 Btu/hr with four burners 15 each having a firing rate of about 25,000 Btu/hr. In another preferred embodiment of this invention, burners 15 may have different firing rates. For example, one burner 15 may have a firing rate of about 20,000 Btu/hr and another burner 15 may have a firing rate of about 30,000 Btu/hr, without effecting the total firing rate of gas-fired heater 10. In one preferred embodiment of this invention, at least one burner 15 has a variable firing rate. According to this invention, a variable firing rate of each burner 15 can be adjusted or controlled periodically to operate at different firing rates.

As shown in FIG. 1, each burner 15 is in fluidic communication with and receives fuel from a fuel supply 20. Fuel supply 20 provides a fuel, preferably but not necessarily natural gas or propane, to each burner 15 wherein the fuel is mixed with a portion of the air needed for complete combustion. Flames issue from each burner 15, mix with at least a remaining portion of the air needed for complete combustion, and enter into heat exchanger 37 releasing heat and combustion products into heat exchanger 37.

In one preferred embodiment of this invention, heat exchanger 37 comprises a plurality of heat exchange tubes 38. Preferably, but not necessarily, each heat exchange tube 38 has a generally circular cross-section. Heat exchange tube 38 may have any suitable shape and/or cross-section known to those skilled in the art. Preferably, but not necessarily, each heat exchange tube 38 is bent along a longitudinal axis of heat exchange tube 38, for example to form an S-shape. In one preferred embodiment of this invention, each heat exchange tube 38 is dedicated to a corresponding burner 15, wherein each heat exchange tube 38 is positioned with respect to and in communication with the corresponding in-shot burner 15 to transfer heat from the corresponding in-shot burner 15. Preferably, but not necessarily, a manifold 40 is in communication with an output end portion of each heat exchange tube 38.

An induced draft fan 42 draws combustion products through each heat exchange tube 38 and manifold 40. Induced draft fan 42 discharges the combustion products to the atmosphere or to any suitable environmental system or apparatus. In one preferred embodiment of this invention, in response to a demand signal from a thermostat or other control device, modulator 30 emits a signal to activate induced draft fan 42. A sensor switch 43 that is responsive to some physical characteristic indicative of normal operation of induced draft fan 42, such as pressure in manifold 40 or rotational speed of induced draft fan 42, energizes an electronic ignition system 50.

Once energized, an electronic ignition system 50 electrically communicates with an ignition source 46, a main gas valve 45, which preferably includes a valve section to directly and independently supply pilot burner 18, and a flame detector 48. An electronic ignition system 50 activates an ignition source 46 located near the outlet of one of the burners 15 or pilot burner 18 and then activates main gas valve 45 to release gas to burners 15 or pilot burner 18. The gas, mixed with some portion of the air needed for complete combustion, issues from each of burners 15 or pilot burner 18 and is ignited by ignition source 46. Electronic ignition system 50 monitors flame detector 48, which is positioned in at or near the flame issuing from burners 15 or pilot burner 18 to ensure that a flame is established at burners 15 or pilot burner 18. For the case in which electronic ignition system 50 first activates main gas valve 45 to release gas to pilot burner 18 and then monitors flame detector 48 to ensure that a flame is established at pilot burner 18, electronic ignition system 50 then activates main gas valve 45 to release gas to burners 15. Electronic ignition system 50 will keep main gas valve 45 activated to release gas to burners 15 or pilot burner 18 as long as flame detector 48 emits and acceptable signal.

Gas-fired heater 10 further comprises a supply blower 35. Preferably, but not necessarily, supply blower 35 draws air from within a conditioned space of the building and the atmosphere and moves return air over or across heat exchanger 37. As the air moves across heat exchanger 37, heat is transferred from heat exchanger 37 by convection and/or conduction. Heated air 36 is forced through a duct system, for example, and circulated throughout the conditioned space of the building.

In one preferred embodiment of this invention, gas-fired heater 10 further comprises at least one control valve 25, such as a solenoid valve, as shown in FIG. 1. As used throughout this specification and in the claims, the term valve is intended to be interchangeable with the terms control valve, solenoid valve or any other type of valve that can be controlled, as known to those skilled in the art. Each valve 25 controls at least one corresponding burner 15. Preferably, each valve 25 is positioned upstream from the corresponding burner 15. Valve 25 is moveable between a fully open position, a partially open position and a closed position to control fuel flow from main gas valve 45 to the corresponding burner 15. In the open position, valve 25 allows fuel flow from main gas valve 45 and the corresponding burner 15. In the closed position, valve 25 prevents or restricts fluidic communication between main gas valve 45 and the corresponding burner 15 and thus prevents the corresponding burner 15 from firing or reduces the firing rate of burner 15.

In one preferred embodiment of this invention, one burner 15' has no corresponding valve 25 positioned upstream, as shown in FIG. 1. As a result, this particular burner 15' continuously fires when gas valve 45 is open and fuel flows to burner 15'. In one preferred embodiment of this invention, at least two burners 15' have no valve 25 positioned upstream to control fuel flow to burner 15'.

As shown in FIG. 1, gas-fired heater 10 further comprises a modulator or modulating device 30. Preferably, but not necessarily, modulator 30 is a digital modulator or is digitally operated. Modulator 30 is in electrical communication with and can receive a signal, such as a temperature indication signal, from a thermostat 60 and/or any other suitable temperature feedback mechanism known to those skilled in the art. Modulator 30 is in electrical communication with induced draft fan 42 to activate or deactivate induced draft fan 42. Modulator 30 is in electrical communication with each valve 25 to electronically control and/or operate movement of each valve 25 independently between the open position, the partially open position and the closed position. Modulator 30 of this invention incrementally modulates the heat input rate of gas-fired heater 10 by independently operating at least one valve 25 to move to the open position, the partially open position or the closed position.

The term incrementally modulate as used throughout this specification and in the claims refers to modulating the heat input of gas-fired heater 10 by either opening or closing one or more valves 25 in response to a demand signal from the thermostat or other temperature feedback mechanism or control device. As valves 25 are opened or closed to maintain the set point, the corresponding burners 15 are activated or deactivated, respectively. The incremental modulation of the heat input rate of gas-fired heater 10 may occur in positive increments or negative increments. The number of increments depends upon the number of independently controllable valves 25 of gas-fired heater 10 and the desired firing rates of corresponding burners 15.

In one preferred embodiment of this invention, modulator 30 comprises a control logic and/or algorithm having adaptive controls and/or parameters related to thermostatic operations. In a first mode, modulator 30 receives feedback or the demand signal from a thermostat, such as either a single stage, a multi-stage, or a zone temperature sensor, which is processed to adaptively control the heat input of gas-fired heater 10. In a second mode, modulator 30 receives information from the thermostat or the zone temperature sensor and information from an on board temperature sensor and/or sensors internal to gas-fired heater 10, which is processed by modulator 30, for example to calculate a rate of temperature change within a conditioned space. The control logic and/or algorithm interprets the feedback information to toggle or increment between in-shot burners 15 firing to control heat input. Modulator 30 then adaptively controls the heat input of gas-fired heater 10 to the conditioned space, accordingly.

Figure 8:
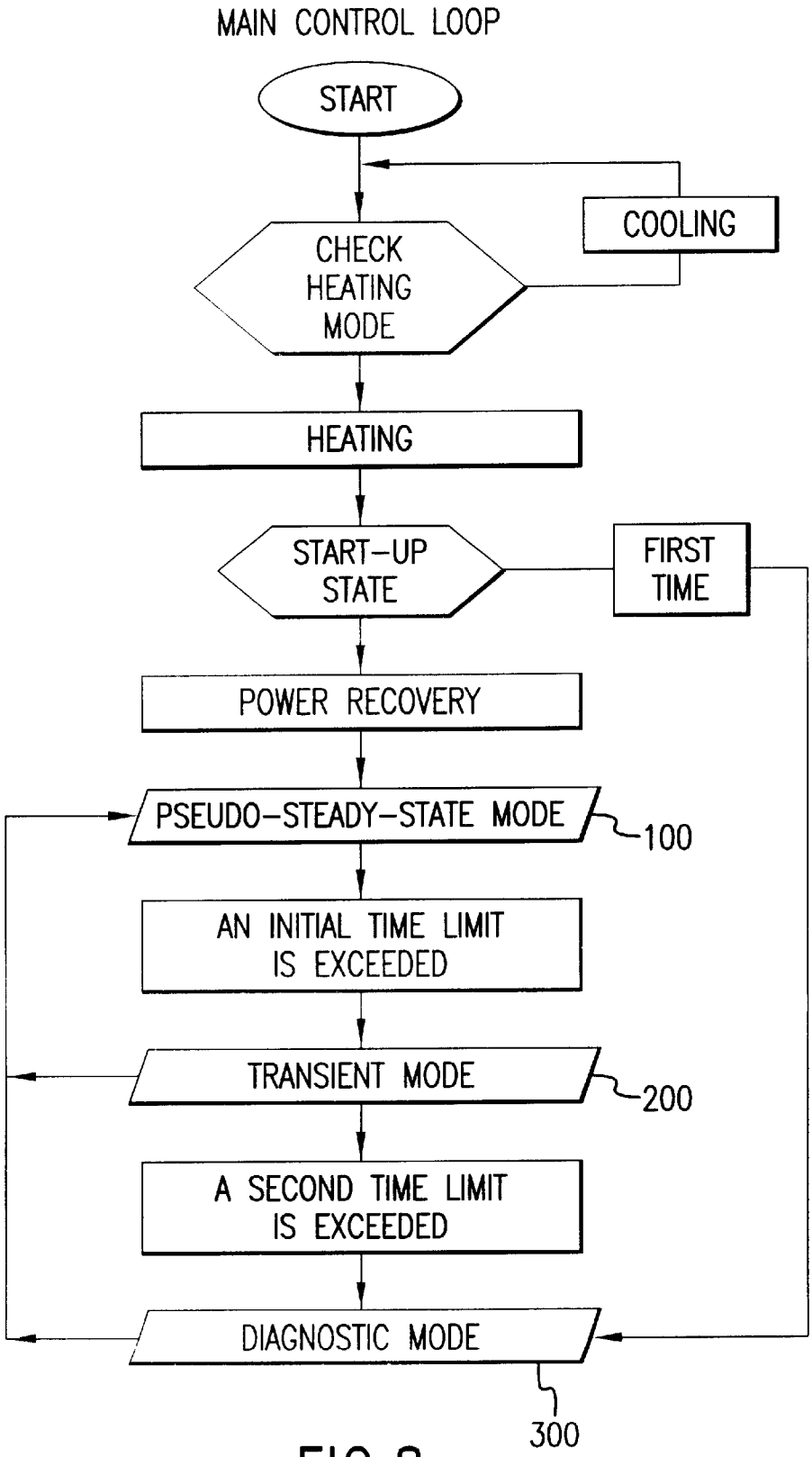
FIG. 8 is a flow diagram of a main control loop of an algorithm for a modulator, according to one preferred embodiment of this invention.

In one preferred embodiment of this invention, a control algorithm provides digital modulation control as a function of one or more demand signals received from a conventional single-stage thermostat. The control algorithm of this invention can adapt to both microelectronic and electromechanical thermostats. In another embodiment, a control algorithm operates using a signal from a two-stage thermostat. Both control algorithms of this invention provide digital control as a function of relatively recent historical information of the operation of gas-fired heater 10. FIG. 8 shows a basic flow diagram for such control algorithms.

A conventional single-stage thermostat or any other conventional temperature feedback mechanism sends a signal to a conventional rooftop unit. An operator sets thermostat 60 to a particular set point in order to maintain a defined zone at a desired temperature. If the zone temperature is above a first temperature, then thermostat 60 emits an off signal. If the zone temperature is below a second temperature which is lower than the first temperature, then thermostat 60 emits an on signal. A hysteresis band, usually a few degrees Fahrenheit, is established between the first temperature and the second temperature. With microelectronic thermostats, the hysteresis band varies as a function of time. With electromechanical thermostats, an anticipator can be used to alter the effect of the hysteresis band, for example to minimize overshoot.

Figure 9:
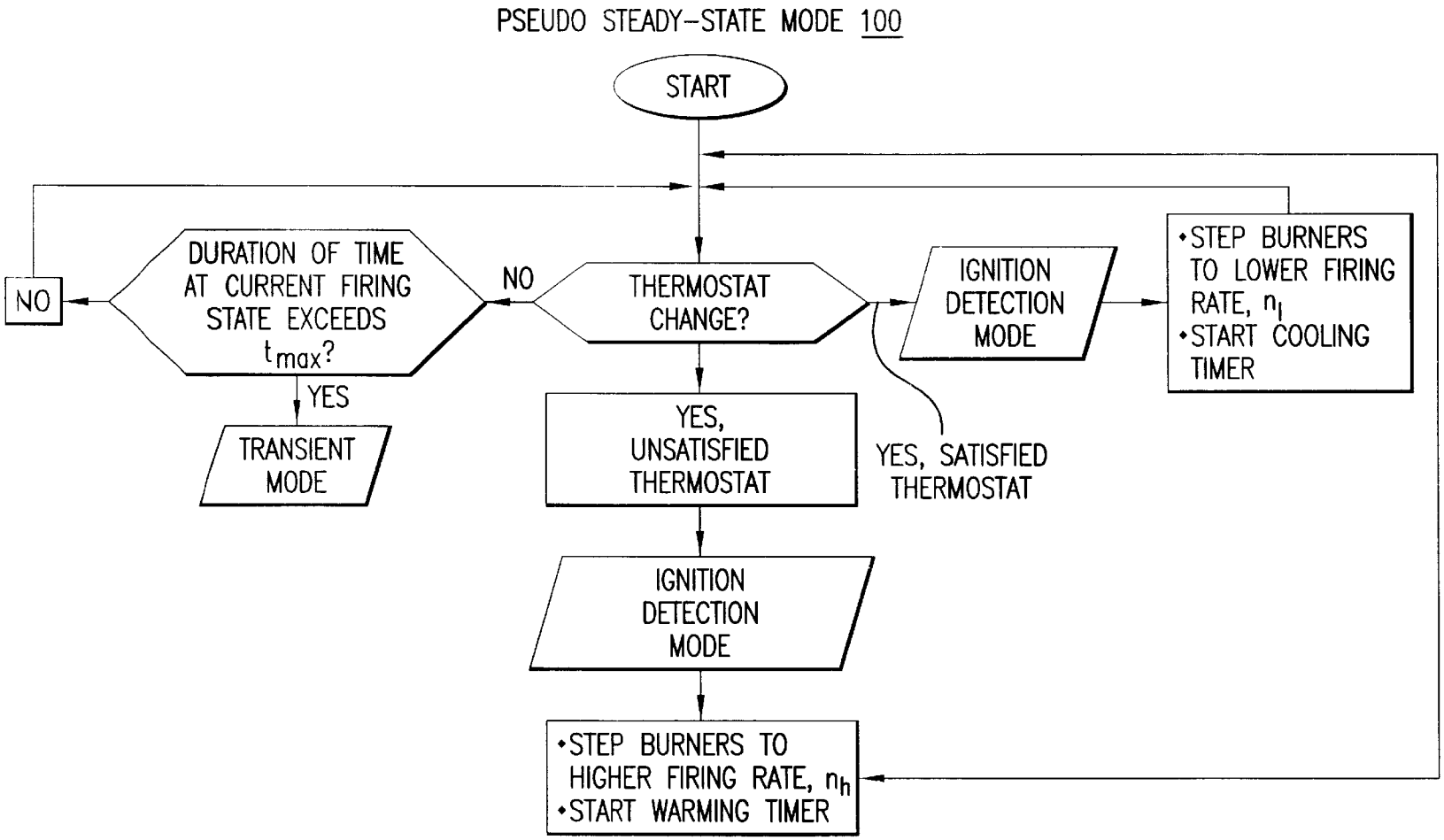
FIG. 9 is a flow diagram of a pseudo-steady-state mode of an algorithm for a modulator, according to one preferred embodiment of this invention.
Figure 10A:
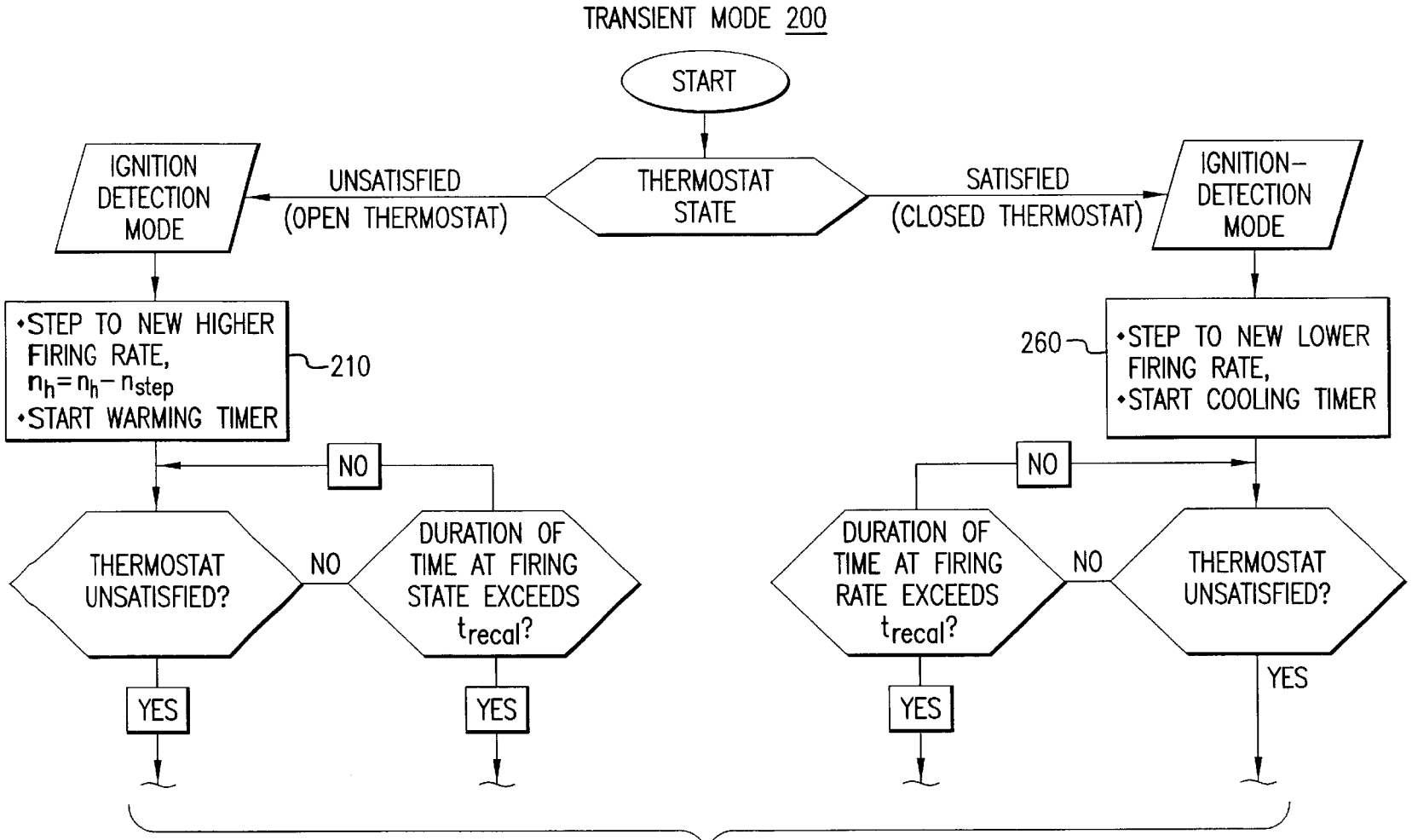
FIG. 10 is a flow diagram of a transient mode of an algorithm for a modulator, according to one preferred embodiment of this invention.
Figure 10B:
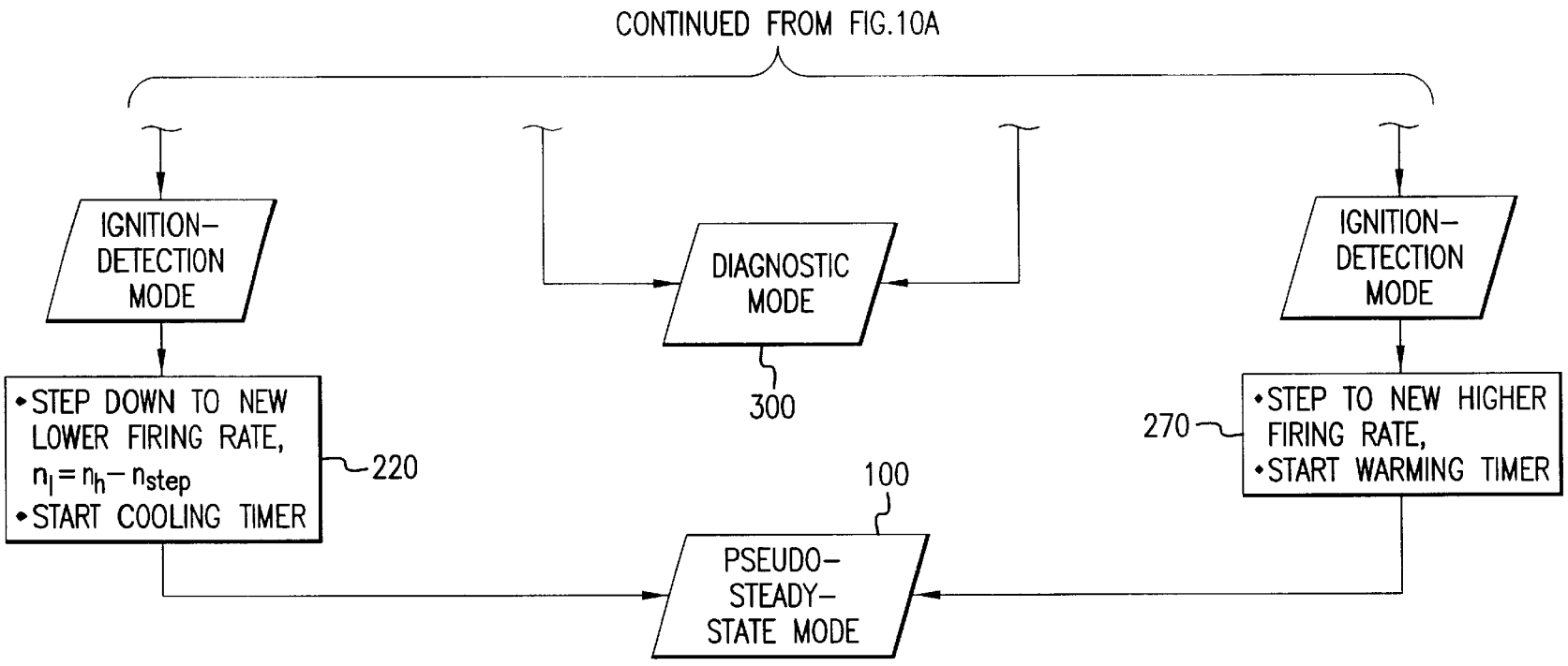
Figure 11A:
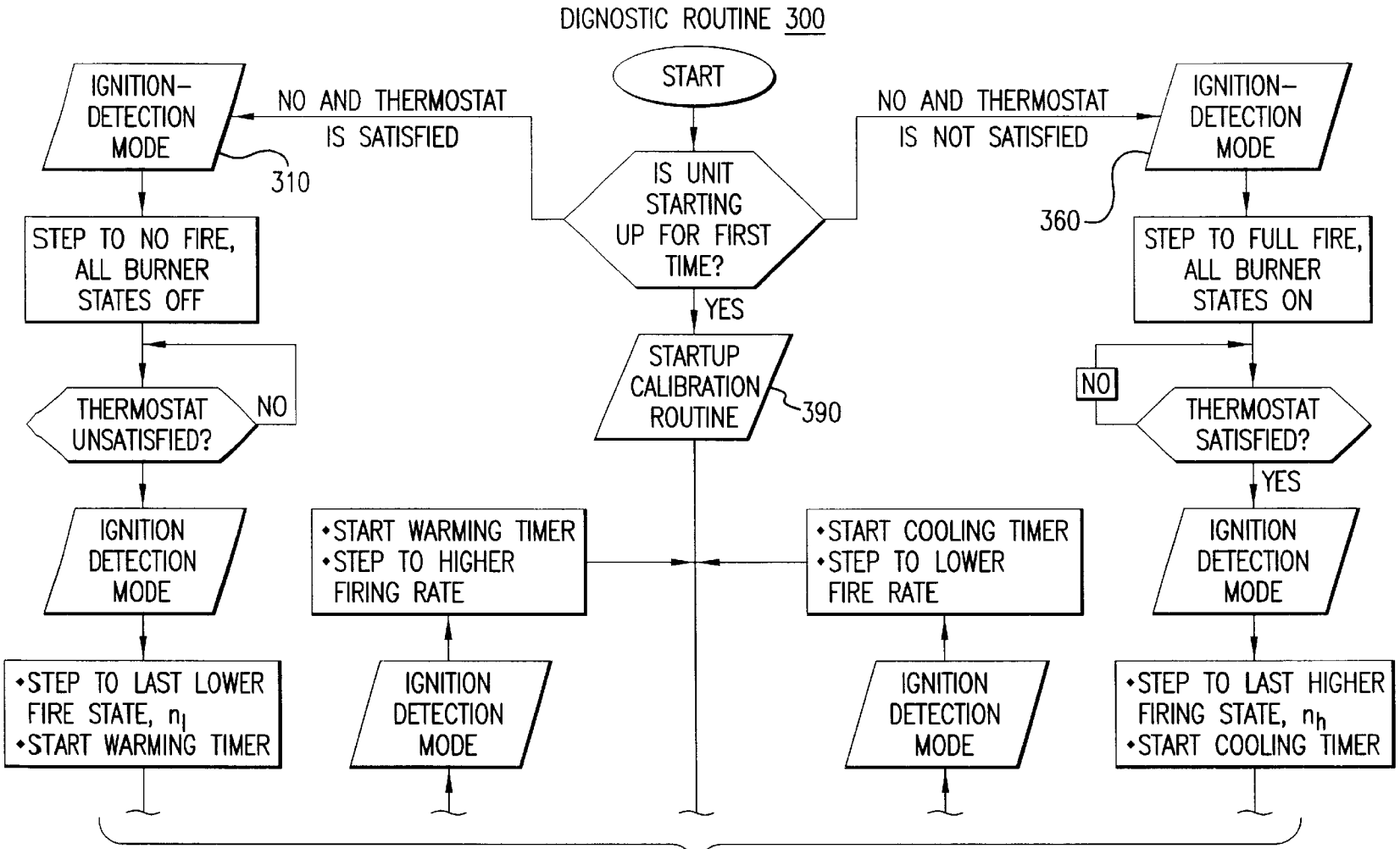
FIG. 11 is a flow diagram of a diagnostic routine of an algorithm for a modulator, according to one preferred embodiment of this invention.
Figure 11B:
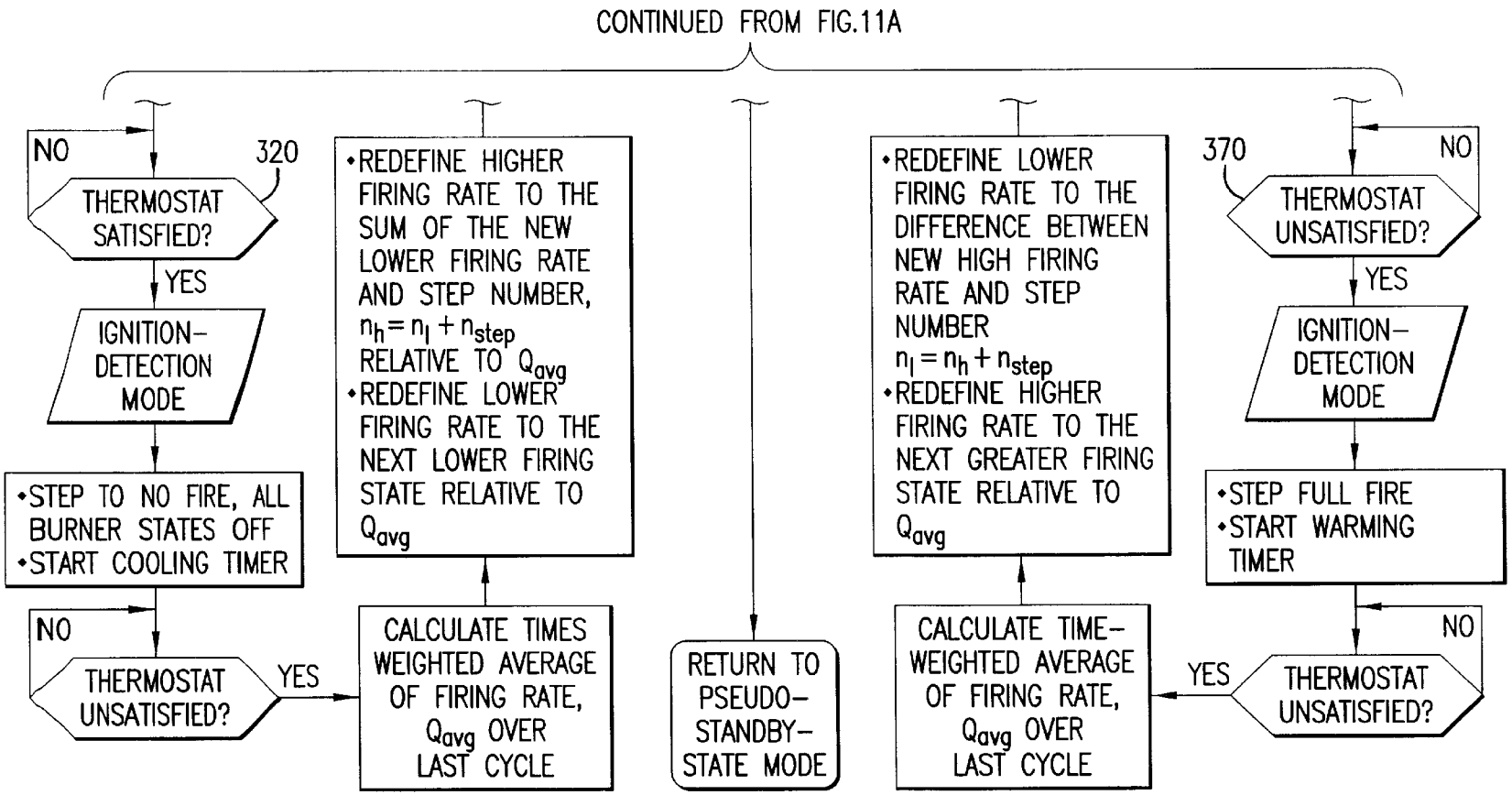

In one embodiment of this invention, as shown in FIG. 8, the control algorithm includes a main control loop with three different modes of operation: a pseudo-steady-state mode 100, as shown in detail in FIG. 9; a transient mode 200, as shown in detail in FIG. 10; and a diagnostic mode 300, as shown in detail in FIG. 11.

FIG. 9 shows a flow diagram for pseudo-steady-state mode 100, according to one embodiment of this invention. During usual operating hours, a digitally modulating rooftop unit will operate in pseudo-steady-state mode 100. Pseudo steady state refers to a smooth operation and interaction between gas-fired heater 10 and the zone, for example when the zone has no significant load changes. In pseudo-steady-state mode 100, modulator 30 can operate burners 15 in a relatively constant fashion, periodically and repetitively operating one burner 15 or a same or different group of burners 15 on and off as dictated by thermostat 60 positioned in the zone, thereby satisfying the zone load.

In pseudo-steady-state mode 100, a certain number of burners 15 are constantly on during an entire on/off cycle. This particular firing rate is called a lower firing rate and these particular burners 15 fire when thermostat 60 calling for no heat. Under conditions of low heating load the lower firing rate may be zero and no burners 15 fire when thermostat 60 is calling for no heat.

When the zone temperature falls below a set point, thermostat 60 emits a demand signal to modulator 30 calling for heat. Modulator 30 then steps up the firing rate to a higher firing rate by turning on an additional burner 15 or an additional set of burners 15. As thermostat 60 cycles between a demand signal for heat and a demand signal for no heat, modulator 30 toggles between the higher firing rate and the lower firing rate, respectively.

For some applications, especially those with an electromechanical thermostat 60, a step between the lower firing rate and the higher firing rate may include several firing rate increments to provide better control. The step number refers to the number of firing rate increments between the lower firing rate and the higher firing rate.

FIG. 10 shows a flow diagram for transient mode 200 of operation. In transient mode 200, the control algorithm of this invention handles relatively large changes in zone load or set point, which pseudo-steady-state mode 100 cannot follow. When operating in pseudo-steady-state mode 100, if modulator 30 senses no change in the demand signal within a prescribed time period $t_{trans}$, then modulator 30 enters transient mode 200. A value for a $t_{trans}$ can be set at any suitable time period, for example at 15 minutes.

Once in transient mode 200, modulator 30 follows one of two routines, depending on the higher firing rate or the lower firing rate.

If modulator 30 operates at the higher firing rate, modulator 30 presumes that the zone receives insufficient heat. Modulator 30 attempts to correct by increasing to a next higher firing rate, as shown in step 210 of FIG. 10.

Modulator 30 then waits for another prescribed time period $t_{diag}$, during which if thermostat 60 is satisfied, as shown in step 220 of FIG. 10, modulator 30 defines the higher firing rate and the lower firing rate as one increment higher than the previous values. Modulator 30 then returns to pseudo-steady-state mode 100, as shown in FIG. 10, and resumes toggling between the new lower firing rate and the higher firing rate. However, if during time period $t_{diag}$ thermostat 60 is not satisfied, modulator 30 assumes that relatively larger load changes have occurred over a relatively short time period and modulator 30 then proceeds to diagnostic mode 30.

If modulator 30 operates at the lower firing rate, modulator 30 presumes that the zone is receiving too much heat. As shown in step 260 of FIG. 10, modulator 30 attempts to correct by decreasing to the next step of the firing rate. Modulator 30 then waits for another time period $t_{diag}$, during which if thermostat 60 is not satisfied, as shown in step 270 of FIG. 10, modulator 30 redefines the higher firing rate and the lower firing rate as one increment lower than the previous values. Modulator 30 then returns to pseudo-steady-state mode 100, as shown in FIG. 10, and resumes toggling between the new lower firing rate and the higher firing rate. However, if during time period $t_{diag}$ thermostat 60 remains satisfied, modulator 30 presumes that relatively larger load changes have occurred over a relatively short time period and modulator 30 enters diagnostic mode 300.

FIG. 11 shows a flow diagram for a diagnostic routine of the control algorithm according to one embodiment of this invention. Diagnostic mode 300 responds to relatively larger and relatively faster changes in load requirements, as compared to transient mode 200. While operating in transient mode 200, if modulator 30 senses no change in the demand signal from thermostat 60 within a second time period $t_{diag}$, then modulator 30 enters diagnostic mode 300.

In diagnostic mode 300, modulator 30 drives the firing rate over many increments, such as from a full firing rate to an off condition, and then estimates a new higher firing rate and lower firing rate that roughly bracket a new zone load.

Modulator 30 returns to pseudo-steady-state mode 100 with the new higher firing rate and the new lower firing rate. Once returned to pseudo-steady-state mode 100, the system dynamics will tune modulator 30 to the load.

Once in diagnostic mode 300, from transient mode 200, modulator 30 follows one of two routines, each which depends upon recent history of operation of gas-fired heater 10. If modulator 30 operates at the higher firing rate, then the zone is not heated enough. Modulator 30 meets the higher load requirement as quickly as possible by activating all burner states or firing at a full rate until thermostat 60 is satisfied. For each present thermostat cycle modulator 30 records a duration of each half of the thermostat cycle. As shown in step 370 of FIG. 11, modulator 30 then returns to the last higher firing rate until thermostat 60 again emits a signal calling for heat. When thermostat 60 calls for heat, modulator 30 activates all burner states. Once thermostat 60 is satisfied at the end of such cycle, modulator 30 calculates a time-weighted average of the firing rate for this cycle.

Modulator 30 uses an average firing rate to select a burner state associated with the next greater firing rate. Modulator 30 then resets the higher firing rate to this particular burner state and resets the lower firing rate to a step below this particular burner state. Modulator 30 then returns to pseudo-steady-state 100 mode and resumes toggling between the new lower rate and the new higher rate.

If modulator 30 is operating at the lower firing rate, the zone is overheated and modulator 30 meets the lower load as quickly as possible by deactivating all valves 25 or by going to a full off condition, until thermostat 60 again calls for heat, as shown by step 310 in FIG. 11.

For the present thermostat cycle, modulator 30 will record a duration of each half of the thermostat cycle. Modulator 30 then returns to the last lower firing rate until thermostat 60 is satisfied. Once thermostat 60 is satisfied, modulator 30 deactivates all valves 25. When thermostat 60 calls for heat at the end of this cycle, modulator 30 calculates a time-weighted average of the firing rate for this particular cycle. Modulator 30 uses this average firing rate to select a burner state associated with the next lesser firing rate. Modulator 30 resets the lower firing rate to this particular burner state and resets the higher firing rate to a step above this particular burner state. Modulator 30 then returns to pseudo-steady-state mode 100 and resumes toggling between the new lower firing rate and the new higher firing rate.

As shown in FIG. 11, diagnostic mode 300 also has a startup calibration routine 390. Modulator 30 can go into startup calibration routine 390 if a substantial time period has passed since the system has been in a heating mode or after a particular event, such as a power failure. Startup calibration routine 390 can satisfy the load quickly and provide a reasonable starting place for pseudo-steady-state mode 100.

Startup calibration routine 390 can adapt a digital modulating system to its application, which is advantageous because a thermostat sensitivity and response to operation of gas-fired heater 10 may differ from one application to another. Some factors affecting thermostat sensitivity and system response include thermostat position, thermostat type, zone size, zone height, and the number of digital states. The adaptation is achieved by varying the number of steps between the higher firing rate and the lower firing rate. Regarding diagnostic mode 300 and transient mode 200, one step in the firing rate is assumed to be between the higher firing rate and the lower firing rate.

Figure 2:
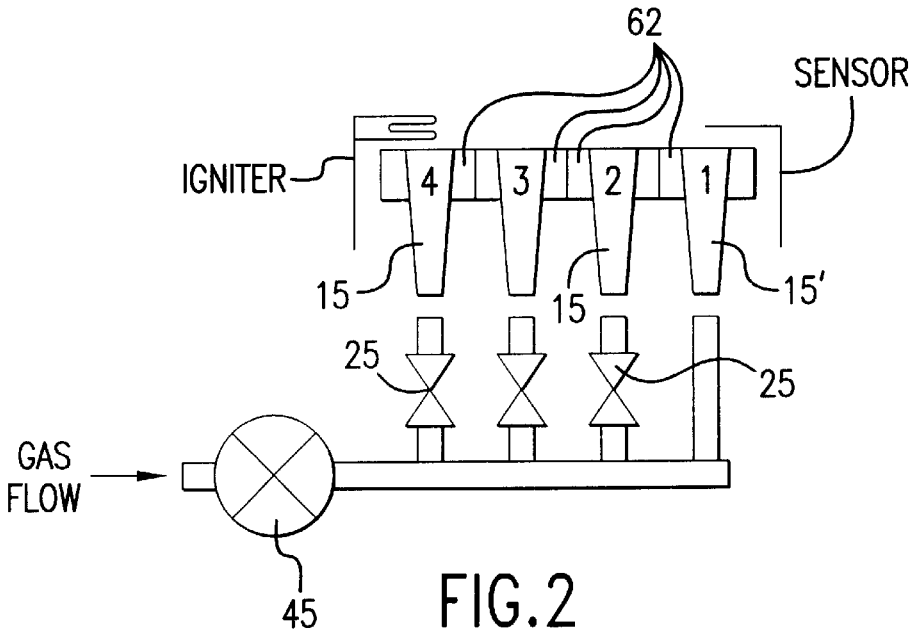
FIG. 2 is a schematic diagram of a gas-fired heater with control valves in parallel, according to one preferred embodiment of this invention.
Figure 3:
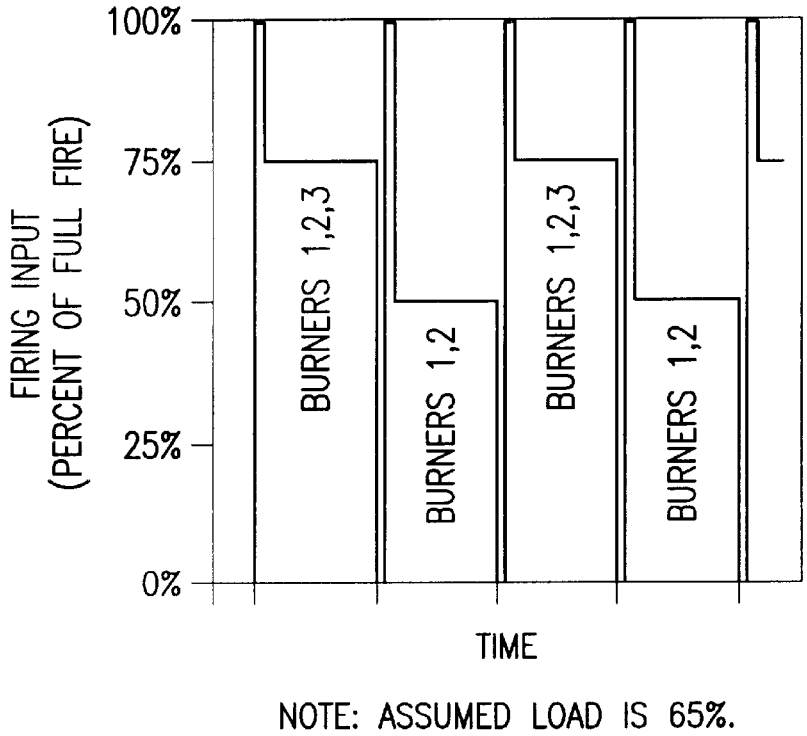
FIG. 3 is a graphical representation of a firing input as a function of time, for the gas-fired heater shown in FIG. 2.
Figure 4:
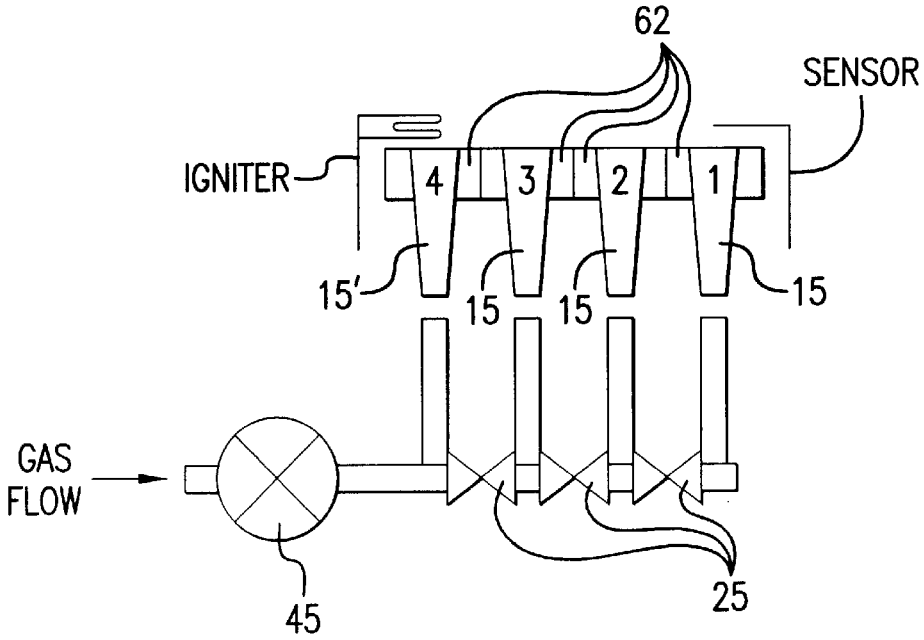
FIG. 4 is a schematic diagram of a gas-fired heater having control valves in series, according to another preferred embodiment of this invention.

As shown in FIGS. 2 and 4, carry-over wings 62 positioned between parallel burners 15 can be used to ensure cross-lighting of adjacent burners 15, particularly in-shot burners. An electronic ignition system can be used with flame sensor 48 located at burners 15', the gas flow to which is controlled only by main combination gas valve 45, and ignition source 46 located at an opposite end of burners 15. Through a process referred to as the ignition detection mode, the burner control valves 25 and the main combustion gas valve 45 are controlled so that for every change in the burner state, the entire burner system is shut down. Then, as soon as possible, the ignition and proof of flame sequence is started, the flame is proven at a fill fire rate, and then modulator 30 can deactivate one or more valves 25 or burners 15 to achieve the desired burner state. FIG. 3 shows a graphical representation of a firing input as a function of time, with a 65% load.

Figure 5:
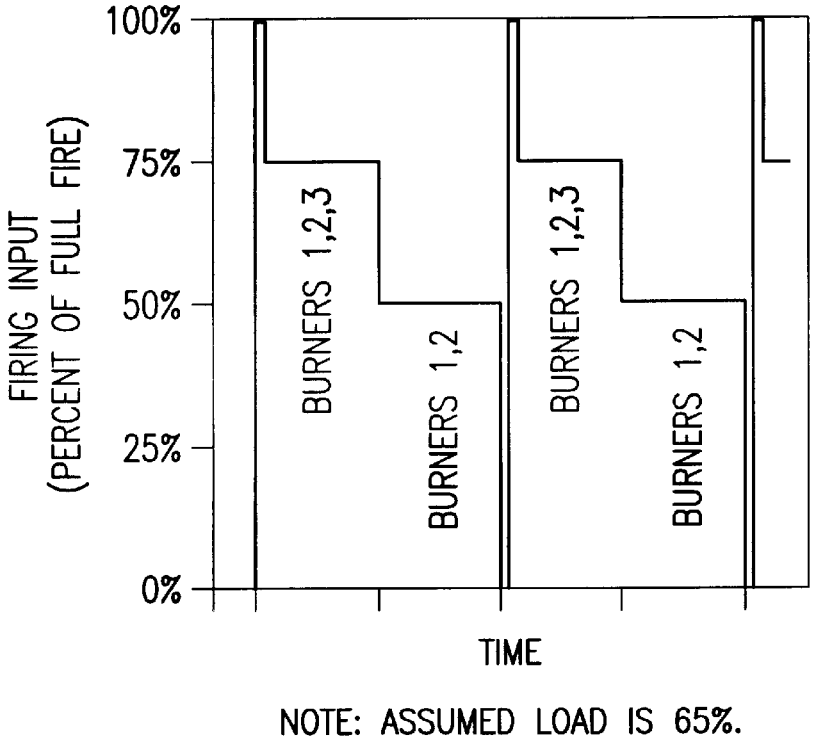
FIG. 5 is a graphical representation of a firing input as a function of time, for the gas-fired heater as shown in FIG. 4.

FIG. 4 shows burners 15 arranged in series and having carry-over wings 62 to ensure cross-lighting of adjacent burners 15. Electronic ignition system 50 is used with a flame sensor 48 located near burners 15', the gas flow to which is controlled only by main combination gas valve 45, and ignition source 46 located at an opposite end of burners 15. Through a process referred to as ignition detection mode, burner control valves 25 and main combination gas valve 45 are controlled, so that for every increase in the burner state, the entire burner system is shut down. Then, as soon as possible, the ignition and proof of flame sequence is started, the flame is proven at full fire, and then modulator 30 can deactivate one or more burners 15, to achieve a desired burner state. FIG. 5 shows a graphical representation of a firing input as a function of time, assuming a 65% load.

Figure 6:
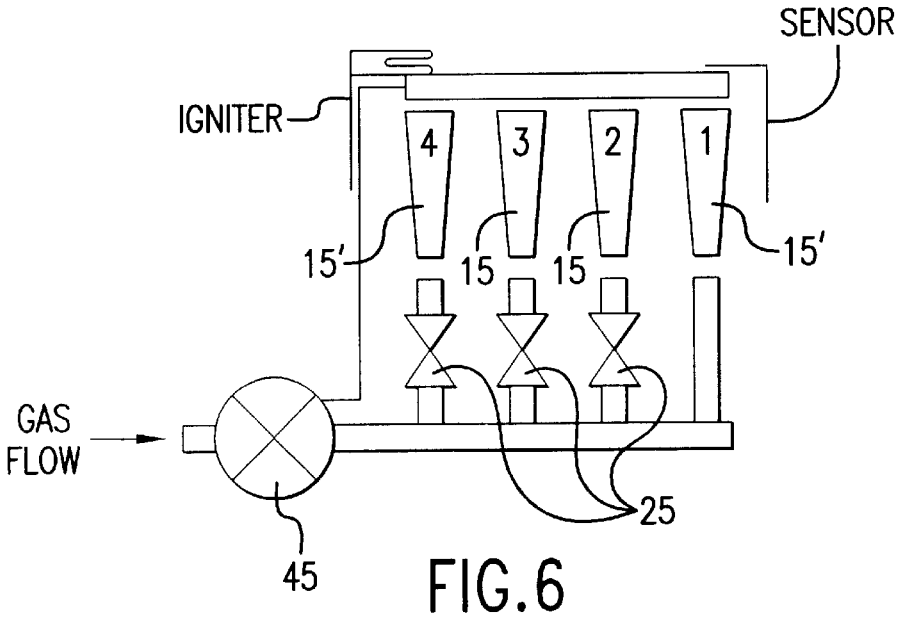
FIG. 6 is a schematic diagram of a gas-fired heater with control valves in parallel and with an intermittent tube pilot, according to another preferred embodiment of this invention.
Figure 7:
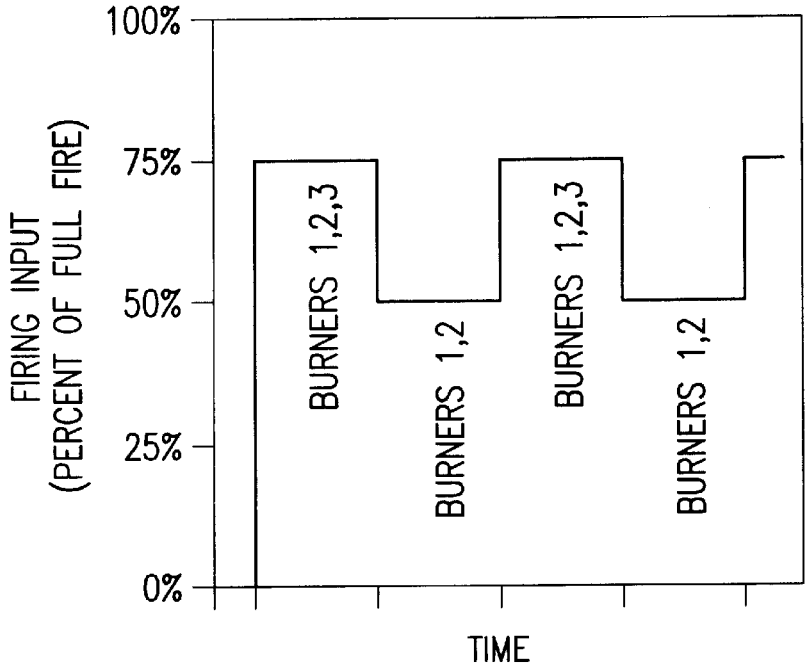
FIG. 7 is a graphical representation of a firing input as a function of time, for the gas-fired heater shown in FIG. 6.

In a preferred embodiment for the ignition system arrangement, FIG. 6 shows burners 15 arranged in parallel, which can be used with or without carry-over wings 62. An intermittent tube pilot burner system is used with flame sensor 48 and ignition source 46 which are located at opposite ends of a tube pilot burner 18. In this configuration burner control valves 25 can be controlled independently of main gas valve 45 so that changes in the burner state can be made without shutting down the entire burner system.

Referring to FIG. 1, in a method for modulating the heat input to gas-fired heater 10, modulator 30 preferably but not necessarily emits a dedicated control signal to each valve 25. The dedicated control signal or signals emitted from modulator 30 independently operates or controls each valve 25 to move at least one valve 25 between the open position, the partially open position and/or the closed position. With valve 25 in the open position, fuel from fuel supply 20 flows to corresponding in-shot burner 15. Additional valves 25 can be independently operated or controlled, for example in response to the demand signal, to move from a closed position, which prevents or restricts fuel flow between fuel supply 20 and the corresponding burner 15, to an open position allowing fuel flow between fuel supply 20 and the corresponding burner 15. The dedicated signal selectively activates the corresponding burner 15 to produce heat and combustion products. Thus, the heat input of gas-fired heater 10 can be incrementally modulated.

For example, gas-fired heater 10 as shown in FIG. 1 has five burners 15 that are activated to fire at approximately equal firing rates for allowing gas-fired heater 10 to operate at a total firing rate of 100%. Preferably, but not necessarily, one burner 15' is not controlled by a corresponding valve 25 and thus fires at a constant firing rate of about 20% of the total firing rate. Modulator 30 selectively deactivates one burner 15 by operating corresponding solenoid valve 25 to move corresponding valve 25 to the closed position, preventing fluidic communication between fuel supply 20 and one burner 15. With one burner 15 deactivated, gas-fired heater 10 operates at about 80% of the total firing rate of gas-fired heater 10. Similarly, an additional burner 15 can be selectively deactivated. As a result, gas-fired heater 10 operates at about 60% of the total firing rate of gas-fired heater 10. Selectively deactivating an additional burner 10 reduces the firing rate of gas-fired heater 10 to about 40% of the total firing rate. An additional burner 15 may be deactivated to operate gas-fired heater 10, for example with only in-shot burner 15', at about 20% of the total firing rate.

In one preferred embodiment of this invention, a flame carry over mechanism is positioned between each of burners 15, to ensure that each corresponding burner 15 ignites when valve 25 is open. In one preferred embodiment of this invention, burners 15 are activated in a specific sequence to ensure proper carry over. However, this sequential activation does not inhibit the ability to modulate the heat input over a wide range.

In another preferred embodiment of this invention, the activated burners 15 have different firing rates. In yet another preferred embodiment of this invention, at least one burner 15 has a firing rate that varies over a time period. Thus, the heat input of gas-fired heater 10 can be incrementally modulated more precisely or at a larger number of increments.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. A method of operating a gas-fired heater to maintain temperature within a zone, the method comprising:

modulating the gas-fired heater between a higher firing rate and a lower firing rate within a pseudo steady-state mode until a current firing rate exceeds a predetermined maximum time period $t_{trans}$;

modulating the gas-fired heater between an updated higher firing rate and an updated lower firing rate within a transient mode until an updated current firing rate exceeds a predetermined maximum time period $t_{diag}$; and redefining the higher firing rate and the lower firing rate in a diagnostic mode until the gas-fired heater returns to the pseudo steady-state mode.

2. The method of claim 1 wherein the step of modulating the gas-fired heater within the pseudo steady-state mode further comprises:

determining whether a thermostat is satisfied or unsatisfied;

stepping burners to the higher firing rate for an unsatisfied thermostat and the lower firing rate for a satisfied thermostat; and initiating one of a warming timer and a cooling timer to determine whether $t_{trans}$ is obtained.

3. The method of claim 1 wherein the step of modulating the gas-fired heater within the transient mode further comprises:

determining whether a thermostat is satisfied or unsatisfied;

stepping burners to the updated higher firing rate for an unsatisfied thermostat and the updated lower firing rate for a satisfied thermostat; and initiating one of a warming timer and a cooling timer to determine whether $t_{diag}$ is obtained.

4. The method of claim 1 wherein the step of modulating the gas-fired heater within the diagnostic mode further comprises:

determining a second time whether the thermostat is satisfied or unsatisfied;

stepping burners to a full firing rate for an unsatisfied thermostat;

stepping burners to full off for a satisfied thermostat;

monitoring the thermostat for a change to either satisfied or unsatisfied;

stepping burners to the updated higher firing rate when the thermostat becomes satisfied;

stepping burners to the updated lower firing rate when the thermostat becomes unsatisfied;

monitoring the thermostat for another change to either unsatisfied or satisfied;

stepping the burners to the fall firing rate when the thermostat becomes unsatisfied; and stepping burners to full off when the thermostat becomes satisfied.

5. The method of claim 4 wherein the step of redefining the higher firing rate and the lower firing rate in the diagnostic mode further comprises:

calculating a weighted average overall firing rate over a last thermostat cycle, either from unsatisfied to satisfied or from satisfied to unsatisfied;

for the thermostat cycle going from satisfied to unsatisfied, redefining the higher firing rate based upon the weighted average overall firing rate and redefining the lower firing rate based upon the redefined higher firing rate;

for the thermostat cycle going from unsatisfied to satisfied, redefining the lower firing rate based upon the weighted average overall firing rate and redefining the higher firing rate based upon the redefined lower firing rate; and returning to a pseudo steady-state mode.

6. The method of claim 1 wherein the step of redefining the higher firing rate and the lower firing rate in the diagnostic mode further comprises:

calculating a number of steps to different firing rates required in the diagnostic mode before return to pseudo steady-state mode; and calculating a redefined higher firing rate and a redefined lower firing rate based upon the number of steps.

7. The method of claim 1 further comprising:

entering an ignition detection mode prior to adjusting a higher firing rate or a lower firing rate.

8. A method of operating a gas-fired heater with a modulator to maintain temperature within a zone, the method comprising:

operating the modulator at a higher firing rate when the zone is not sufficiently heated;

operating the modulator at a lower firing rate when the zone is sufficiently heated;

toggling between the higher firing rate and the lower firing rate in a pseudo steady-state mode;

sensing an updated heat requirement from a thermostat;

adjusting the higher firing rate and the lower firing rate based upon the updated heat requirement in a transient mode; and toggling between an adjusted higher firing rate and an adjusted lower firing rate.

9. The method of claim 8 further comprising:

entering a diagnostic mode when one of the adjusted higher firing rate and the adjusted lower firing rate exceeds a predetermined maximum time period $t_{diag}$.

10. The method of claim 9 further comprising:

redefining the higher firing rate and the lower firing rate within the diagnostic mode.

11. The method of claim 10 further comprising:

calculating a redefined higher firing rate and a redefined lower firing rate based upon a weighted average of overall firing rates within a cycle.

12. The method of claim 11 further comprising:

entering the pseudo steady-state mode using the redefined higher firing rate and the redefined lower firing rate.

13. A method of operation of a gas-fired heater comprising:

operating the gas-fired heater within a load zone between a high firing rate and low firing rate in a pseudo steady-state mode of operation;

sensing a change in a demand signal within a prescribed time period $t_{trans}$; entering a transient mode if no change is sensed within $t_{tran}$s;

sensing a change in a demand signal within a second prescribed time period, $t_{diag}$;

entering a diagnostic mode if no change is sensed within $t_{diag}$;

driving a firing rate of the gas-fired heater over a plurality of increments to determine a new load zone;

estimating a new high firing rate and a new low firing rate based upon the new load zone; and returning to the pseudo steady-state mode of operation.

* * * * *